US005730049A

United States Patent [19]

Broschart

[11] Patent Number: 5,730,049

[45] Date of Patent: Mar. 24, 1998

[54] METHOD AND APPARATUS FOR HIGH SPEED PRINTING IN A MAILING MACHINE

[75] Inventor: Mark M. Broschart, Prospect, Conn.

[73] Assignee: Pitney Bowes Inc., Stamford, Conn.

[21] Appl. No.: 583,258

[22] Filed: Jan. 5, 1996

[51] Int. Cl.[6] ..... B41J 3/54

[52] U.S. Cl. ..... 101/91; 400/82

[58] Field of Search ..... 400/82, 124.08; 101/91, 93

[56] References Cited

U.S. PATENT DOCUMENTS

| | | | |
|---|---|---|---|
| 3,580,515 | 5/1971 | Casselli | 239/536 |
| 4,215,350 | 7/1980 | Mielke et al. | 346/75 |
| 4,288,799 | 9/1981 | Uzawa et al. | 346/140 R |
| 4,344,079 | 8/1982 | Chambors et al. | 346/140 R |
| 4,364,060 | 12/1982 | Jinnai et al. | 346/75 |
| 4,393,386 | 7/1983 | DiGiulio | 346/75 |
| 4,401,991 | 8/1983 | Martin | 346/75 |
| 4,412,226 | 10/1983 | Yoshida | 346/1.1 |
| 4,511,907 | 4/1985 | Fukuchi | 346/140 R |
| 4,686,540 | 8/1987 | Leslie et al. | 346/1.1 |
| 4,692,041 | 9/1987 | Dyma et al. | 400/82 |
| 4,709,244 | 11/1987 | Pitt et al. | 400/175 |
| 4,960,338 | 10/1990 | Sheldon | 400/124.08 |
| 5,065,170 | 11/1991 | Rezanka et al. | 346/1.1 |
| 5,070,345 | 12/1991 | Lahut et al. | 346/1.1 |
| 5,109,239 | 4/1992 | Cobbs et al. | 346/140 R |
| 5,117,374 | 5/1992 | Goetz | 346/75 |
| 5,184,900 | 2/1993 | Eisner et al. | 400/82 |
| 5,190,382 | 3/1993 | Koshiishi et al. | 400/124.28 |
| 5,208,605 | 5/1993 | Drake | 400/82 |
| 5,297,017 | 3/1994 | Haselby et al. | 400/82 |
| 5,374,943 | 12/1994 | Lehmann et al. | 400/124.28 |
| 5,415,089 | 5/1995 | Eckert, Jr. et al. | 101/91 |
| 5,467,709 | 11/1995 | Salomon | 101/93 |
| 5,524,989 | 6/1996 | Ichioka et al. | 400/124.02 |

FOREIGN PATENT DOCUMENTS

| | | | |
|---|---|---|---|
| 122169 | 6/1985 | Japan | 400/82 |

*Primary Examiner*—Edgar S. Burr
*Assistant Examiner*—Steven S. Kelley
*Attorney, Agent, or Firm*—Steven J. Shapiro; Melvin J. Scolnick

[57] ABSTRACT

A mailing machine includes structure for transporting a mailpiece at a constant speed through the mailing machine in a processing direction; structure for continuously determining a position of the mailpiece in the mailing machine; a first printhead having first nozzles aligned transverse to the processing direction; a second printhead having second nozzles aligned adjacent to the first nozzles and transverse to the processing direction; structure for coordinating the selective energizing of the first and second nozzles in synchronism with each other and the position of the mailpiece so that the first printhead only prints first predetermined columns of ink dots of an indicia image on the mailpiece and the second printhead only prints second predetermined columns of ink dots of the indicia image on the mailpiece, the second predetermined columns of ink dots being in interlaced relationship in the processing direction with the first predetermined columns of ink dots whereby the first and second columns of ink dots together form the indicia image. A method includes the steps of aligning at least first and second printheads in a processing direction of a substrate to be printed on; moving the substrate in the processing direction past the first and second printheads; selectively energizing the first printhead to only print first predetermined columns of ink dots of an image on the substrate; selectively energizing the second printhead to only print second predetermined columns of ink dots of the image on the substrate, the second predetermined columns of ink dots being in interlaced relationship in the processing direction with the first predetermined columns of ink dots whereby the first and second columns of ink dots together form the image.

9 Claims, 3 Drawing Sheets

FIG. 2
35
| C1 | C2 | C3 | C4 |
|---|---|---|---|
| 1 | 1 | 1 | 1 |
| 1 | 0 | 1 | 0 |
| 0 | 1 | 0 | 1 |
| 1 | 1 | 1 | 1 |
| 1 | 0 | 1 | 0 |
| 0 | 1 | 0 | 1 |
| 1 | 1 | 1 | 1 |
FIG. 3A
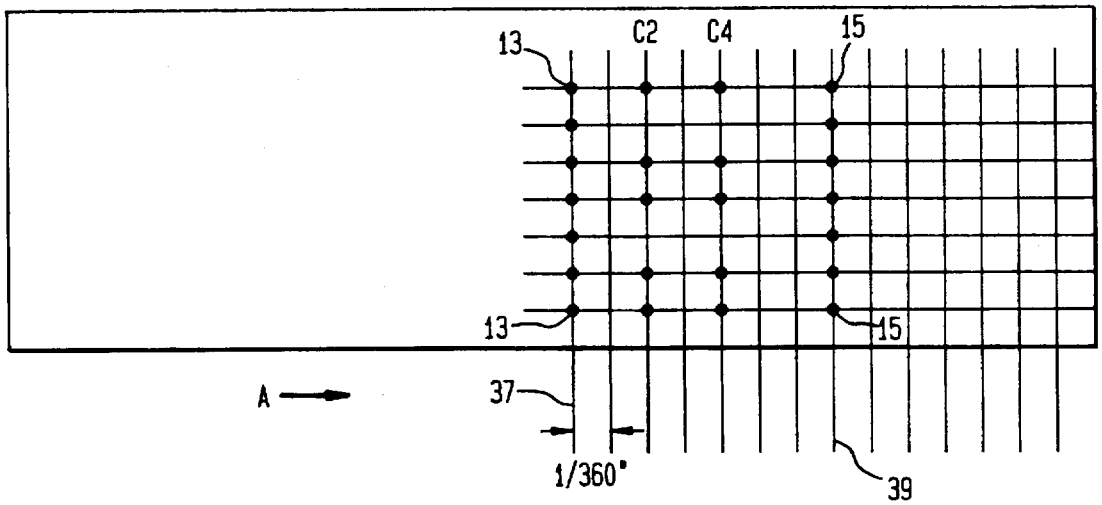
FIG. 3B
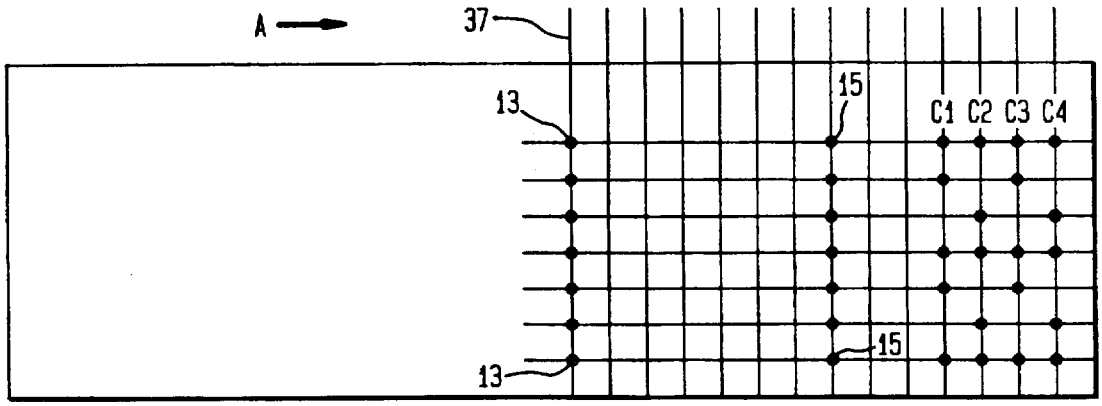

METHOD AND APPARATUS FOR HIGH SPEED PRINTING IN A MAILING MACHINE

BACKGROUND

This invention relates to a method and an apparatus for printing images in a mailing machine and more particularly to a method and apparatus for high-speed printing in a mailing machine.

Mailing machines are utilized for processing mailpieces such as envelopes. The most basic type of mailing machine provides the capability of transporting mailpieces to a postage meter which in turn prints an indicia image on the mailpiece. Additionally, more sophisticated mailing machines can include front end feeders, rear end stackers, envelope flap sealing capabilities and various other collation and envelope inserting stations. Traditionally, the postage meters used in a mailing machine utilized a die/platen configuration or a rotary drum/impression roller configuration to imprint the indicia on the mailpiece. While these traditional postage meters performed admirably over time, they were limited by the fact that if the indicia image needed to be significantly changed, the platen/die or the rotary drum/impression roller configuration would have to be replaced. Newer postage meters now take advantage of modern digital printing technology to overcome the deficiencies of the traditional meters discussed above. The advantage of digital printing technology is that since the digital printhead is software driven, all that is required to change an indicia image is new software. Thus, flexibility in changing indicia images or adding customized advertising slogans is significantly increased.

Modern digital printing technology includes thermal ink jet (bubble jet), piezoelectric ink jet, thermal printing techniques, and LED and laser xerographic printing which all operate to produce images by dot-matrix printing. In dot-matrix ink jet printing individual print elements in the printhead (such as resistors or piezo electric elements) are either electronically stimulated or not stimulated to expel or not expel respectively, drops of ink from a reservoir onto a substrate. Thus, by controlling the timing of the energizing of each of the individual print elements in conjunction with the relative movement between the printhead and the mailpiece, a dot-matrix pattern is produced in the visual form of the desired indicia.

While the use of digital printing in postage meters has significant advantages as discussed above, the corresponding use of such postage meters in mailing machines presents a problem. That is, high speed mailing machines are typically required to process 90 envelopes (standard 10" envelopes) per minute, at a minimum, and often are required to process up to 240 envelopes per minute. However, a standard, off-the-shelf office ink jet printer is designed to operate at less than 25 inches per second (ips). The ips is defined by the operating frequency of the specific printhead divided by the printing resolution in the process direction. For example, a printhead specified to operate at 7200 Hz and print at 360 dots per inch (dpi) results in a print speed of 20 inches per second (7200/360). Accordingly, if the envelope is being processed through the mailing machine at the printing speed of the printhead (20 ips) only 120 envelopes per minute are capable of being processed. Therefore, if a printhead designed to operate at 20 ips is used in a mailing machine, the only way to process more than 120 envelopes per minute is to feed the envelopes to the printhead at a higher speed, slow down the envelopes to the print speed during printing, and accelerate the envelopes to a higher speed during ejection to make room for the next envelope. It is well known in the mailing machine industry that constant-speed machines are more reliable, less noisy, produce less dust, and cost less to design, manufacture and maintain than variable-speed mailing machines. Accordingly, what is needed is a printing mechanism for a mailing machine that can operate at a speed sufficient to support franking of envelopes at greater than or equal to 240 envelopes per minute using a single-speed transport mechanism, such as for example, a transport mechanism operating at 40 inches per second.

SUMMARY OF THE INVENTION

It is an object of the invention to provide a method and apparatus which permits use of commercial printheads in a mailing machine while providing a high speed mailpiece processing capability.

A mailing machine which meets the above object includes structure for transporting a mailpiece at a constant speed through the mailing machine in a processing direction; structure for continuously determining a position of the mailpiece in the mailing machine; a first printhead having first nozzles aligned transverse to the processing direction; a second printhead having second nozzles aligned adjacent to the first nozzles and transverse to the processing direction; structure for coordinating the selective energizing of the first and second nozzles in synchronism with each other and the position of the mailpiece so that the first printhead only prints first predetermined columns of ink dots of an indicia image on the mailpiece and the second printhead only prints second predetermined columns of ink dots of the indicia image on the mailpiece, the second predetermined columns of ink dots being in interlaced relationship in the processing direction with the first predetermined columns of ink dots whereby the first and second columns of ink dots together form the indicia image.

The method which meets the above object includes the steps of aligning at least first and second printheads in a processing direction of a substrate to be printed on; moving the substrate in the processing direction past the first and second printheads; selectively energizing the first printhead to only print first predetermined columns of ink dots of an image on the substrate; selectively energizing the second printhead to only print second predetermined columns of ink dots of the image on the substrate, the second predetermined columns of ink dots being in interlaced relationship in the processing direction with the first predetermined columns of ink dots whereby the first and second columns of ink dots together form the image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 2 is a bit map image;

FIG. 3A shows the first part of a printing sequence of the printed image corresponding to the bit map image of FIG. 2;

FIG. 3B shows the final printed image produced by the inventive printing method;

DETAILED DESCRIPTION OF THE PREFERRED EMBODIMENTS

Figure 1:
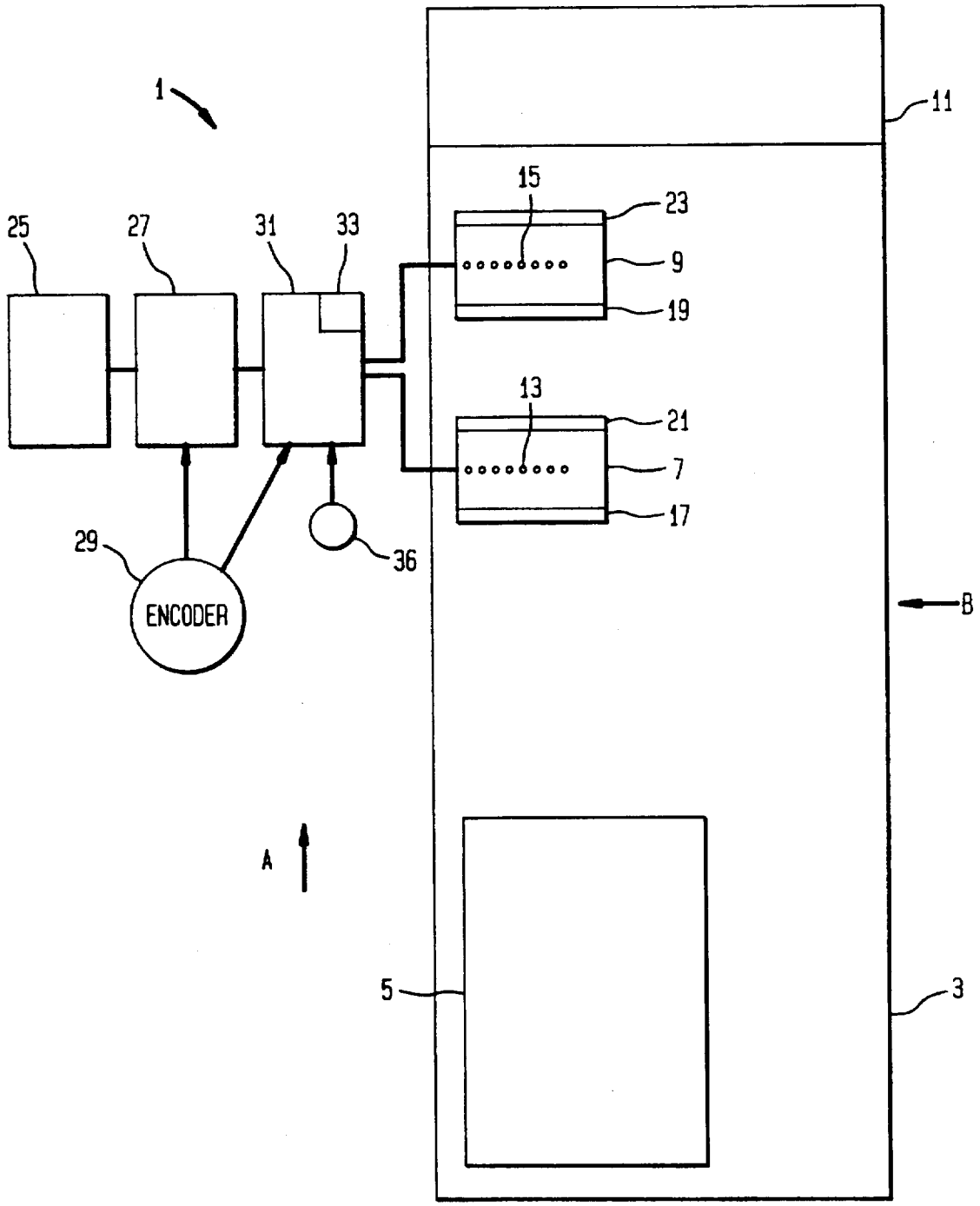
FIG. 1 is a schematic diagram of the inventive mailing machine.

FIG. 1 schematically shows an overview of portions of a mailing machine 1 incorporating the claimed invention. Mailing machine 1 includes a conventional transport/registration device 3 which moves the mailpiece 5 at a single speed in the direction of arrow "A" from its position shown to a position below first and second printheads 7, 9 where printing of an indicia image on mailpiece 5 occurs. In the preferred embodiment, mailpiece 5 is transported at a constant speed, such as 40 ips, past printheads 7, 9 and into a stacking bin 11 subsequent to printing of the indicia image. Printheads 7, 9 are aligned with each other along the path of travel of mailpiece 5 and each have a single row of nozzles 13, 15 which are substantially perpendicular to the processing direction "A" of mailpiece 5. However, it is important to note that the row of nozzles 13, 15 can be angled relative to the perpendicular direction in order to improve the density of the ink dots produced by each of the printheads 7, 9 in the non-mailpiece processing direction identified by the arrow "B".

Each printhead 7, 9 has a shift register 17, 19 therein and a holding register 21, 23 which are used to hold individual columns of bits of the digital indicia image which is to be printed on mailpiece 5. The functioning of the shift register and the holding register are conventional.

Mailing machine 1 further includes a vault microprocessor 25 which performs the accounting function of postage meter 1 in a conventional manner, a base microprocessor 27 which controls various conventional functions of mailing machine 1 such as control of the transport device 3, a conventional encoder 29 which is used to provide a signal to base microprocessor 27 indicative of the position of mailpiece 5 as it is transported by transport mechanism 3, and a printhead microprocessor 31 which also receives encoder 29 signals. Printhead microprocessor 31 controls the firing of each printhead 7, 9 (as discussed in more detail below) in coordination with the position of mailpiece 5. A memory 33 associated with printhead microprocessor 31 has a bit-mapped digital indicia image stored therein in a conventional manner which is accessed by printhead microprocessor 31 to provide the bit-map data indicia image on a column-by-column basis to shift registers 17, 19, with the subsequent transfer of that column data to holding registers 21, 23. Upon receipt of a strobe signal from printhead microprocessor 31, individual ones of nozzles 13, 15 are selectively energized or not energized to print individual columns of the desired indicia image. That is, since the digital indicia image is a matrix of a series of parallel columns of ink dots, the dots required to be produced in each column are created by controlling the energizing or not energizing of each of the nozzles 13, 15 in synchronization with the position of mailpiece 5 as determined by the encoder 29 signals.

A detailed description of the operation of the inventive apparatus is set forth below in connection with FIGS. 2, 3A, and 3B. In FIG. 2, a simple representative digital image to be printed is shown as a rectangular bit map 35 consisting of a matrix of 1's and 0's. Each column (C1, C2, C3, and C4) of the bit map data 35 is obtained by printhead microprocessor 31 from memory 33 and is sent as a column of data bits to one of shift registers 17, 19 of printheads 7, 9, with each data bit being associated with one of the individual nozzles 13, 15. The column of data in the shift registers 17 or 19 is respectively transferred to its corresponding holding register 21, 23 when the next column of image data is sent to the shift register. In the preferred embodiment, nozzles 13, 15 are substantially perpendicular to the feed direction A of mailpiece 5 and are sufficient in number to generate a full column of image data when a strobe signal is sent from printhead microprocessor 31 to the holding registers 21, 23 the data bits in the holding registers 21, 23 are sent to a corresponding one of nozzles 13, 15 such that a bit of "1" causes a drop to be fired from a nozzle and a bit of "0" indicates that no drop is to be printed. The encoder 29 signals are used to generate the strobe signal to ensure that the columns (C1–C4) of printed data are at a controlled distance apart. This distance is referred to as the "printing pitch" which is equal to the reciprocal of the "print resolution". Typical values of print resolution in the direction of printing are 200 dpi, 240 dpi, 300 dpi, and 360 dpi. A resolution of 360 dpi produces a pitch of 0.002778 inches.

As shown in FIG. 2, bit map 35 includes odd columns of data (C1, C3) and even columns of data (C2, C4). In the preferred embodiment, printheads 7, 9 are mounted so that the arrays of nozzles 13, 15 are spaced an integer (n) multiple of the printing pitch apart from each other. As shown in FIGS. 3A and 3B the position 37 of nozzles 13 and the position 39 of nozzles 15 is separated by 7/360 inches. Microcontroller 31 is programmed so that the bit mapped data for columns C2, C4 are sent to printhead 7 while the bit mapped data for columns C1, C3 are sent to printhead 9. However, the energizing of nozzles 15 are delayed by an appropriate number of encoder 29 counts so that the printed ink dots of columns C1, C3 are alternated with the ink dot columns of C2, C4. In FIG. 3A the print pattern (dark dots) when the column data C2, C4 has been printed but before the column data C1, C3 has been printed is shown while in FIG. 3B the print pattern after the odd and even arrays have been printed is shown. The resulting image is at the desired dot density of 360 dpi in the processing direction of mailpiece 5, but each printhead 7, 9 is effectively printing at 180 dpi since they are each only printing every other column of image data. With each printhead printing at 180 dpi a print speed of 40 ips (7200/180) is obtainable utilizing a standard printhead operating at 7200 Hz. Thus, the synergistic effect of utilizing the printheads 7, 9 to print odd and even columns of the digital bit map image provides a much greater printing speed than would be possible by either of printheads 7, 9 individually.

While the above preferred embodiment was shown in connection with two printheads, the same basic concept can be extended to 3, 4 or more printheads to further increase the print speed. However, in the arrangement set forth in the preferred embodiment it has clearly been shown that 240 envelopes per minute can be processed using two standard, off the shelf, office printers.

Figure 4:
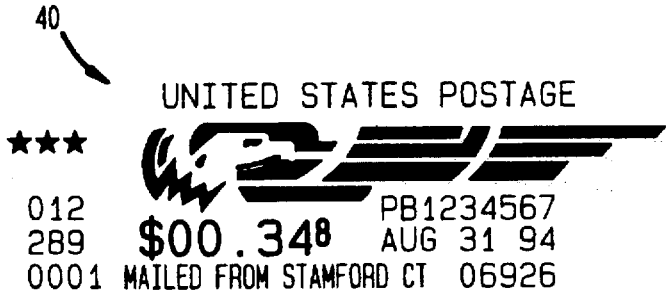
FIG. 4 shows an indicia image.

While the image shown in FIGS. 3A and 3B is a basic dot pattern used for ease of explanation of the invention, it is important to note that the indicia image of FIG. 4 can be printed using the same inventive structure set forth above. That is, the indicia image 39 of FIG. 4 can also be built on a column-by-column dot matrix basis utilizing the alternating printhead printing concept set forth above.

Regarding the above structure, one of the implications of ganging the printheads 7, 9 in the mailpiece process direction "A" is the need to space the heads an exact integer multiple of the printing pitch apart. This can lead to increased manufacturing costs associated with required very high tolerances. On the other hand, if normal tolerances are used, such as 0.005 inches, a tolerance on the spacing between the printheads 7, 9 would be + or −0.010 inches. This spacing tolerance is significantly larger than the maximum print pitch of 0.005 inches and would lead to obvious image defects. However, since all printheads interface with a serial data clock 37 (which can be associated with any of the aforementioned microprocessors 27, 27, 31) that typically operates in the 1–8 MHz range, it is possible to use the clock 37 to "fine tune" the timing offset between printheads 7, 9. An EEPROM or similar non-volatile memory circuit associated with printhead microprocessor 31 can be used to store the timing offset.

Figure 5:
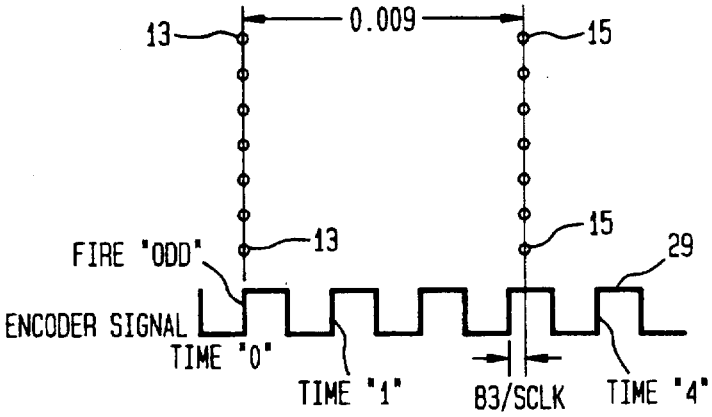
FIG. 5 shows a timing diagram associated with energizing of the printheads.

With reference to FIG. 5, two approaches for storing the offset in NVM can be used. The first uses the number of dock 37 pulses while the second uses the number of encoder 29 pulses for a gross setting followed by a number of clock 37 pulses for a final fine adjustment. In FIG. 5 the spacing between the nozzles 13 and nozzles 15 is 0.009 inches. Moreover, the print resolution of each printhead 7, 9 is 360 dpi, the print speed is 40 ips, and the clock 37 operates at 5 MHz (0.000008 inches per clock cycle at 40 ips). Thus, in the first approach the offset timing is 0.009/0.000008=1125 clock 37 cycles. In the second approach the offset timing would be 3 encoder 29 counts plus 83 clock 37 cycles.

The delay is easily implemented as a preloaded counter within the control logic of the printer electronics or within the control software of printhead microprocessor 31. Thus, in producing the digital image of FIG. 2 the energizing of nozzles 15 is delayed by one encoder count plus 1125 clock 37 cycles or 4 encoder counts plus 83 clock cycles relative to the energizing of nozzles 13 with nozzles 13 printing columns C2, C4 and nozzles 15 printing columns C1, C3.

The mailing machine 1 can have a fine tuning knob on a front panel thereof (not shown) which can be used to fine tune the printed image. That is, if an operator notices a shift in the image he can turn the fine tune button. Since movement of the fine tune button correlates to a certain number of clock cycles, the initially stored offset timing can be changed as required to produce a clearer image. Additionally this fine tuning adjustment may be required if, for example, a single printhead needs to be replaced.

Figure 6:
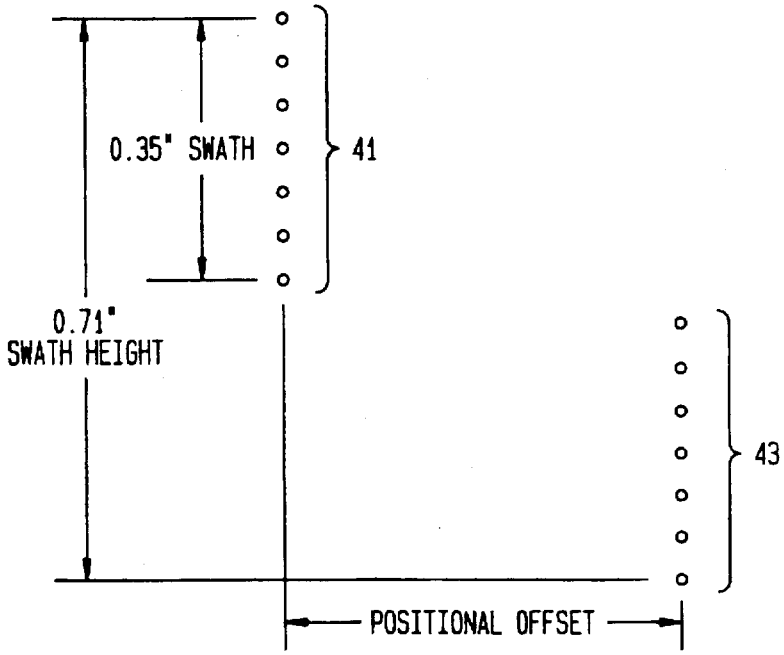
FIG. 6 shows a staggered printhead arrangement to which the inventive method can be applied.

The above timing approach can also be used to account for the physical offset between staggered arrays of nozzles such as the arrays 41, 43 shown in FIG. 6. In such a staggered array implementation, a single printhead is insufficient to print the correct image height and multiple heads (arrays) are required with each head printing a portion of the full image height. Because of the construction of off-the-shelf printheads, the individual arrays cannot be butted end to end; therefore they must be staggered as shown in FIG. 6. Utilizing the above offset approach helps to ensure that alignment of the printed image portion by each array 41, 43 are aligned in the horizontal direction.

The above concepts can also be used during the manufacturing process. That is, when the printheads are assembled they can fire dots onto a glass plate set below. On the other side of the glass plate is a conventional CCD array which can digitize the dots of ink on the glass plate and through appropriate software determine the exact spacing between the nozzles. This information can then be translated into the desired offset of clock cycles or clock cycles/encoder counts and loaded into the NVM control circuits for the printheads.

On a final note, it is understood by those possessing ordinary skill in the art that instant invention differs from color printers which deposit different colors of ink from different printheads at a single super pixel location to create a desired colored super pixel. The super pixels in effect only represent a single color pixel of the image. In the claimed invention each pixel of an image is a single ink dot and the alternate columns of pixels are printed by different printheads 7, 9.

What is claimed is:

1. A mailing machine comprising:

means for transporting a mailpiece at a constant speed through the mailing machine in a processing direction;

means for continuously determining a position of the mailpiece in the mailing machine;

a first ink jet printhead fixed in the mailing machine and having only a first row of nozzles aligned transverse to the processing direction;

a second ink jet printhead having only a second row of nozzles aligned adjacent to the first row of nozzles and transverse to the processing direction, said first and second rows of nozzles operating at a predetermined firing frequency to produce ink dots on the mailpiece such that as the mailpiece is processed at the constant speed the first and second rows of nozzles are not individually capable of producing an indicia image on the mailpiece at a predetermined ink dot density in the processing direction at a desired printing speed;

means for coordinating-the selective energizing of the first and second rows of nozzles in synchronism with each other and the position of the mailpiece so that the first ink jet printhead only prints first predetermined columns of ink dots of the indicia image on the mailpiece and the second ink jet printhead only prints second predetermined columns of ink dots of the indicia image on the mailpiece, the second predetermined columns of ink dots being in interspersed relationship in the processing direction with the first predetermined columns of ink dots whereby the printing of the interspersed first and second columns of ink dots together form the indicia image at the predetermined ink dot density at the desired printing speed.

2. A mailing machine as set forth in claim 1, wherein the coordinating means further comprises means for selectively energizing the first ink jet printhead to only print one of all of the even numbered columns of the indicia image and the odd numbered columns of the indicia image and for selectively energizing the second ink jet printhead to only print the other of all of the even numbered columns of the indicia image and the odd numbered columns of the indicia image.

3. The mailing machine as set forth in claim 2, further comprising means for delaying the energizing of the first and second ink jet printheads relative to each other by a timing offset based on a serial data clock cycle.

4. A mailing machine as set forth in claim 1, wherein the constant speed is greater than 25 inches per second.

5. A mailing machine as set forth in claim 3, further comprising a vault microprocessor which accounts for postage funds and a base microprocessor for controlling the transport means, and wherein the serial data clock is associated with one of the vault microprocessor and the base microprocessor.

6. A method for high-speed printing of an indicia image in a mailing machine comprising the steps of:

aligning at least first and second ink jet printheads each having only a single row of nozzles in a fixed position in a processing direction of a substrate to be printed on;

moving the substrate in the processing direction at a constant speed past the first and second ink jet printheads;

selectively energizing the first ink jet printhead to only print substantially perpendicular to the processing direction first predetermined columns of ink dots of an indicia image on the substrate;

selectively energizing the second ink jet printhead to only print substantially perpendicular to the processing direction second predetermined columns of ink dots of the indicia image on the substrate, the second predetermined columns of ink dots being in interspersed relationship in the processing direction with the first predetermined columns of ink dots whereby the first and second columns of ink dots together form the indicia image at a predetermined ink dot density in the processing direction;

operating the first and second ink jet printheads at a predetermined firing frequency such that as the substrate is processed at the constant speed each of the first and second ink jet printheads is not individually capable of producing the indicia image at the predetermined ink dot density in the processing direction.

7. The method as recited in claim 6, further comprising selectively energizing the first ink jet printhead to only print one of all of the even numbered columns of the image and the odd numbered columns of the image and selectively energizing the second ink jet printhead to only print the other of all of the even numbered columns of the image and the odd numbered columns of the image.

8. The method as recited in claim 7, further comprising delaying the energizing of the first and second ink jet printheads relative to each other by a timing offset based on a serial data clock cycle.

9. The method as recited in claim 8, wherein the substrate on which printing by the first and second ink jet printheads occurs is a mailpiece.

* * * * *